US007341154B2

(12) United States Patent
Boer

(10) Patent No.: US 7,341,154 B2
(45) Date of Patent: Mar. 11, 2008

(54) WATER BATH SEPARATOR

(75) Inventor: Pieter Boer, Wachtum (NL)

(73) Assignee: Bollegraaf Beheer Appingedam B.V., Appingedam (NL)

( * ) Notice: Subject to any disclaimer, the term of this patent is extended or adjusted under 35 U.S.C. 154(b) by 217 days.

(21) Appl. No.: 11/088,375

(22) Filed: Mar. 24, 2005

(65) Prior Publication Data

US 2005/0230291 A1 Oct. 20, 2005

Related U.S. Application Data

(60) Provisional application No. 60/557,229, filed on Mar. 29, 2004.

(51) Int. Cl.
*B03B 5/00* (2006.01)
*B03D 1/00* (2006.01)

(52) U.S. Cl. ..... 209/172.5; 209/172; 209/208

(58) Field of Classification Search ..... 209/172, 209/172.5, 173, 208
See application file for complete search history.

(56) References Cited

U.S. PATENT DOCUMENTS

| | | | | |
|---|---|---|---|---|
| 4,266,676 | A * | 5/1981 | Ruckstuhl et al. | 209/672 |
| 4,294,691 | A * | 10/1981 | Patzlaff | 209/3.1 |
| RE31,023 | E * | 9/1982 | Hall, III | 405/37 |
| 4,483,768 | A | 11/1984 | Gazzoni | |
| 4,750,995 | A * | 6/1988 | Fogerson | 209/173 |
| 5,480,034 | A * | 1/1996 | Kobayashi | 209/667 |
| 6,250,477 | B1 * | 6/2001 | Swanink | 209/386 |
| 6,293,407 | B1 * | 9/2001 | Bajema | 209/495 |
| 6,340,378 | B1 * | 1/2002 | Hinrichsen | 75/436 |
| 6,527,124 | B1 * | 3/2003 | Nakhei-Nejad | 209/173 |
| 2005/0230291 | A1 * | 10/2005 | Boer | 209/672 |

FOREIGN PATENT DOCUMENTS

| | | |
|---|---|---|
| EP | 0925847 | 6/1999 |
| GB | 695543 A | 8/1953 |

OTHER PUBLICATIONS

"LUBO Water-Bath Separator", LUBO Screening & Recycling Systems B.V., pp. 1-2, dated prior to Mar. 24, 2005.

* cited by examiner

*Primary Examiner*—Patrick Mackey
*Assistant Examiner*—Terrell Matthews
(74) *Attorney, Agent, or Firm*—Pearne & Gordon LLP

(57) ABSTRACT

A water bath separator includes a tank for receiving a volume of water for forming a water bath having a top water surface and a light material conveyor path extending from the tank such that an upstream end of the light material conveyor path is closely below the top water surface when the tank is in filled operating condition. The light material conveyor path includes a sorting conveyor provided with a row of rotatable, driven shafts mutually spaced in a conveying direction and each extending transversally to that conveying direction. The shafts each carry a row of radially extending impellers for intermittently urging material on the sorting conveyor upward and in conveying direction, the impellers of each of said rows being mutually spaced in longitudinal direction of the respective shaft. The sorting conveyor has an upstream portion located in the tank such that an upstream end of the sorting conveyor is immersed in the water bath when the tank is in filled operating condition.

12 Claims, 3 Drawing Sheets

WATER BATH SEPARATOR

This application claims the benefit of U.S. Provisional Patent Application Ser. No. 60/557,229 filed on Mar. 29, 2004.

TECHNICAL FIELD AND BACKGROUND ART

The invention relates to water bath separator for separating floating material from material that sinks when deposited in a water bath.

A known application of water bath separators is in the field of sorting construction and demolition waste. Depositing construction and demolition waste in a landfill is expensive. Recycling of potentially re-usable constituents of the waste replaces the costs of disposing a usable or re-usable fraction of the waste by the creation of value of the usable or re-usable materials obtained thereby create a value and contributes to reducing the consumption of natural resources.

Construction and demolition waste is preferably first sized to present only clean, large items on an "covers" sort line. The "unders" line can screen out a product as fine as sand and have the balance cleaned up with an air system, for instance such that a stream of particles mainly having sizes in a range between 1 cm and 2.5 cm is obtained. A water-bath separator is preferably used after that for separating a flotsam fraction from a jetsam fraction of the "unders" or the "covers" material. The sorting may also be carried out in another order, with other size ranges or even only to sort floating particles from sinking particles.

The material to be separated is fed to the water bath and a water flow is maintained in the water bath that entrains the floating fraction to a conveyor that picks up the floating material out of the water bath towards a vibrating screen where water that loosely clings to the material is separated from the material.

The heavier material is transported by an incline conveyor from a lower portion of the water bath to a granulate bunker, or can be send over a quality control sorting line, for the final check for materials, such as PVC.

A problem of water bath separators is that particles of the light fraction of the materials to be sorted are not always quickly engaged by the conveyor for removal from the water bath. In particular, particles that float deeply, such as materials having a specific weight close to the specific weight of water, such as tropical wood or particles having a particular shape, sometimes remain at the upstream end of the discharge conveyor before being entrained out of the water bath.

SUMMARY OF THE INVENTION

It is an object of the invention to provide a solution for more reliably and quickly discharging floating material from a water bath separator.

According to the invention, this object is achieved by providing a water bath separator according to claim 1.

In operation, the impellers of the upstream end of the sorting conveyor impart not only traction in conveying direction onto the floating particles that have floated to the contours of the rotary trajectories of the impellers, but also upward motion, so that the contact pressure between the floating particles and the impellers is temporarily increased from a very low pressure, which is due to the floatation of the particles in the water, to a peak pressure that allows the particles to be engaged effectively by the impellers.

Particular embodiments of the invention are set forth in the dependent claims.

Further objects, features, effects and details of the invention are described below with reference to a presently most preferred embodiment shown in the drawings.

MODES FOR CARRYING OUT THE INVENTION

Figure 1:
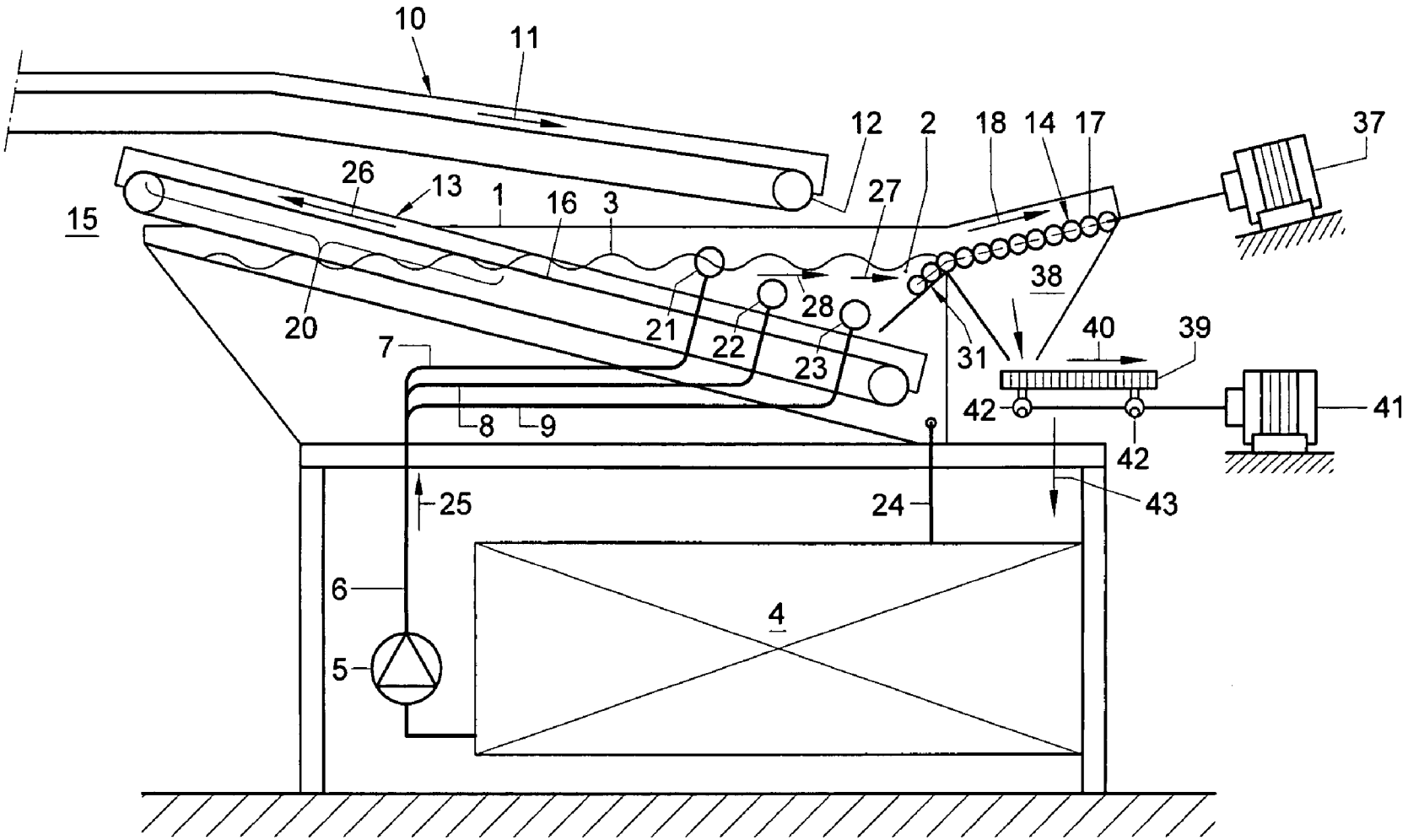
FIG. 1 is schematic, partially cut-away side view of an example of a water bath separator according to the invention.
Figure 2:
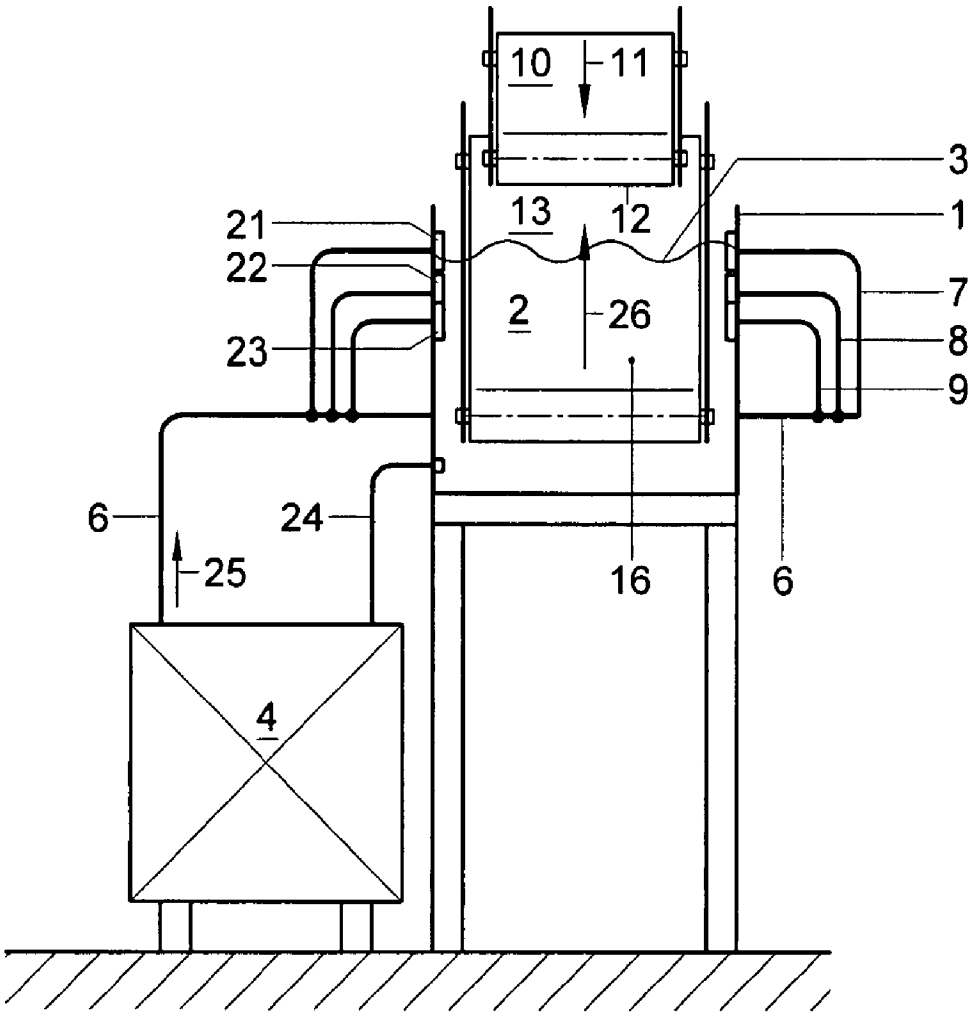
FIG. 2 is a partially cut-away end view of the separator shown in FIG. 1.
Figure 4:
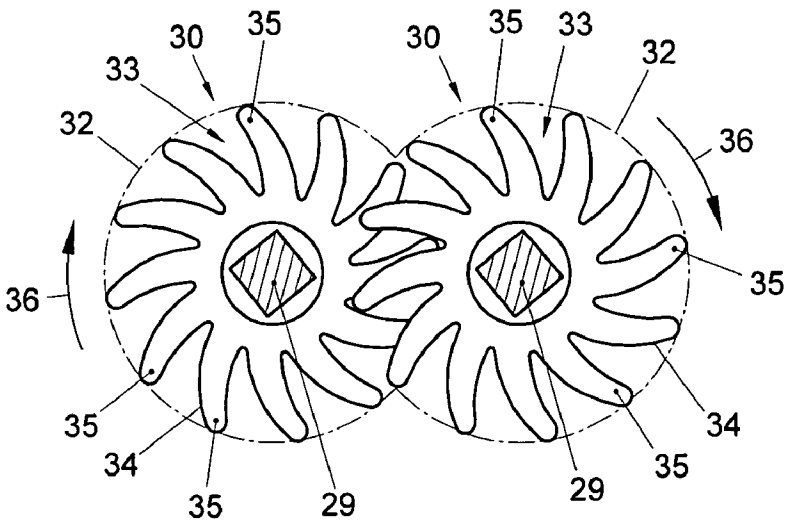
FIG. 4 is a side view in cross section along the line IV-IV in FIG. 3.
Figure 3:
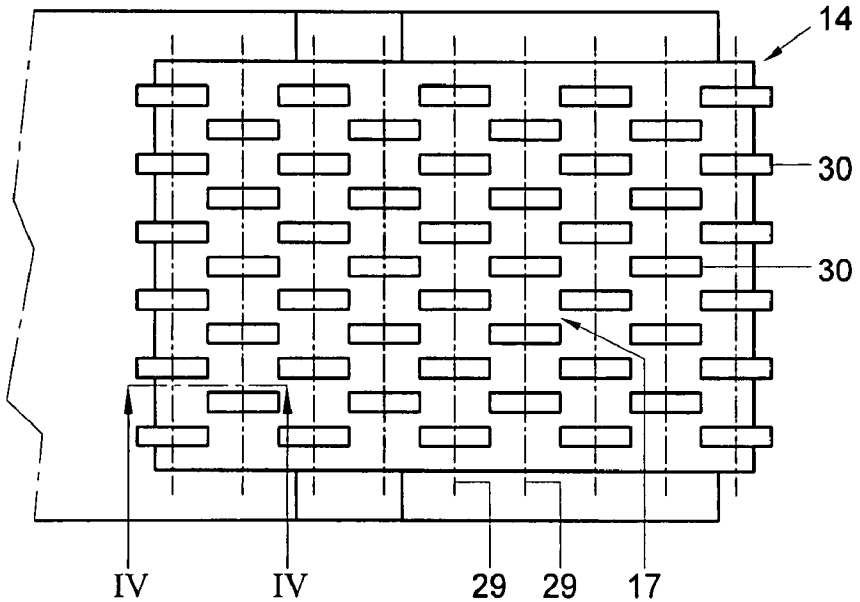
FIG. 3 is a top plan view of a sorting conveyor of the separator according to FIGS. 1 and 2.

The water bath separator shown in the drawings is equipped with two water tanks, a separating tank 1 for receiving a volume of water for forming a water bath 2 having a top water surface 3 and a buffer tank 4 for storing a buffer volume of water for replenishing the water bath 2 to compensate for water displacements out of the water bath 2. A pump 5 in a return conduit 6 is provided for pumping water into the separating tank 1 via the conduit 6 and branches 7-9 thereof.

Feeding of material to be sorted to the water bath 2 is preferably carried out at a relatively constant rate, so that the amount of material fed to the tank is on the one hand limited to avoid that floating and sinking particles prevent each other from floating up and sinking down and, on the other hand, the sorting capacity of the separator is fully used. Although the material to be sorted may be fed to the water bath 2 in many ways, for ensuring a controlled and relatively constant supply rate, a supply conveyor 10 is provided for conveying materials to be sorted in a transport direction 11. The supply conveyor 10 has a downstream end 12 extending above the bath 2 and ending above a portion of the bath 2 about half way between the locations where a heavy material conveyor 13 and a light material conveyor 14 intersect the water surface 3.

The heavy material conveyor 13 defines a conveyor path 16 in a direction 26 extending from a lower portion of the tank 1 to an unloading area 15 outside the tank 1, where material transported along the conveyor path 16 is deposited.

The light material conveyor 14 defines a conveyor path 17 in a direction 18 extending from an upper portion of the tank 1—closely (preferably 20-40 cm) below the water surface 3 when the tank 1 is in filled, operating condition—located at a higher level than the lower portion of the tank 1 from which the heavy material conveyor path 16 extends.

For maintaining a flow along the top water surface 3 away from an upper portion 20 of the heavy material conveyor path 16 that intersects the top water surface 3 when the tank 1 is in filled operating condition, a structure for causing a flow in the water bath 2 is provided. According to the present example, the return conduit 6, its branches 7-9, the pump 5, outflow orifices 21-23 and the buffer storage tank 4 form this structure. However, also other means for maintaining such a flow are conceivable, such as driven propellers or vanes in the water bath 2. A discharge conduit 24 is provided for emptying the tank 1.

In operation, water is circulated through the conduits and the tanks in accordance with the arrow 25 and this results in a flow pattern in the water bath 2 as indicated by arrows 27, 28. The water flows out of the tank over an edge that extends under the light material conveyor 14, for instance at a rate of 200-300 $m^3$/hour into the buffer storage tank 4 (arrow 43). Because the water flow along the top water surface 3 is directed away from the upper portion 20 of the heavy material conveyor path 16 that intersects the top water surface 3 when the tank 1 is in filled operating condition, material that floats in the water drifts towards the light material conveyor 14 by which it is picked up out of the water bath 2. Material that sinks reaches an upstream portion of the heavy material conveyor 13 and is conveyed along the conveying path 16 out of the water bath 2 separate from the light material.

The light material conveyor path 17 is formed by a sorting conveyor in the form of a row of rotatable, driven shafts 29 mutually spaced in the conveying direction 18 and each extending transversally to the conveying direction 18. The shafts 29 each carry a row of radially extending impellers 30 for intermittently urging material on the sorting conveyor upward and in conveying direction 18. The impellers 30 of each of the rows are mutually spaced in longitudinal direction of the respective shaft 29 and the sorting conveyor has an upstream portion 31 located in the tank 1 such that an upstream end of the sorting conveyor is immersed in the water bath 2 when the tank 1 is in filled operating condition.

In operation, the impellers 30 of the upstream end of the sorting conveyor impart not only traction in conveying direction 18 onto the floating particles that have floated to the contours 32 of the rotary trajectories 33 of the impellers 30, but also upward motion, so that the contact pressure between the floating particles and the impellers 30 is temporarily increased from a very low pressure, which is due to the floatation of the particles in the water, to a peak pressure that allows the particles to be engaged effectively by the impellers 30.

The vertical accelerations and decelerations of the particles also contribute to separating water and any non-floating material clinging to the floating particles from the floating particles before removal out of tank 1 containing the water bath 2, immediately from the start of conveyance of particles along the conveyor path 17.

The rotary trajectories 33 of the impellers 30 carried by the shafts 29 project between rotary trajectories 33 of the impellers 30 carried by a neighbouring one of the shafts 29, so that successive impellers 30 are in close succession and particles are effectively advanced along the conveying path 17.

Particles floating above the upstream end of the conveying path 17 are particularly effectively engaged, because the impellers 30 each have a contour 34 that is shaped such that members 35 project radially outward from adjacent portions of that contour 34. According to this example, the members 35 are provided in the form of fingers 35, a plurality of fingers 35 being circumferentially distributed around each impeller 30. The fingers 35 are preferably made of rubber or another resilient material and extend radially outward with a tangential component opposite to the sense of rotation 36 of the impellers 30 when in operation. This allows the projecting members 35 to absorb impacts of transported material particularly effectively.

The impellers 30 carried by the most upstream one of the shafts 29 are positioned to be fully immersed in the water bath 2 when the tank 1 is in filled operating condition. This allows floating particles to be conveyed out of the bath 2 to float to a position above the most upstream impellers 30, so that the impellers 30 engage the particles more effectively and can also engage particles with a relatively large draft from below for effectively imparting upward movement and traction in conveying direction to such particles.

According to the present example, the impellers 30 are releasably fixed to the shafts 29 and driving of the impellers 30 is achieved by the driving rotation of the shafts 29. To this end, a motor 37 is provided that is coupled to the shafts 29 for driving the shafts 29.

The sorting conveyor 14 extends over a sifting area 38 for receiving undersize material and water fallen through the sorting conveyor 14, so that conveying light materials out of the bath 2 and sorting of the light materials by size and separation of water from the larger particle size fraction of these light particles is achieved by the same conveyor 14.

For further separation of water from the undersize fraction, a sieve 39 is provided in and downstream of the sifting area 38 for sieving water from the undersize material. In operation, the sieve 39 is vibrated such that material on the sieve 39 is conveyed in transport direction 40. A motor 41 and an excenter transmission 42 drive vibration of the sieve 39. Water that is separated at the sieve 39 is passed to the buffer storage tank 4 (arrow 43). The oversize fraction of the light material is conveyed by the conveyor 14 past the sifting area 38 to a bunker or other storage facility.

Also the heavy material is conveyed to a bunker or other storage facility.

Within the framework of the invention as defined by the claims construed in the light of technical and functional considerations including those appearing from the description, many other embodiments than the above-described embodiment are conceivable, such as an embodiment in which the conveying path for conveying the flotsam (light) and jetsam (heavy) material fractions do not project out of the bath in opposite directions but at the same side of the bath or at an end and a lateral side of the bath. The jetsam material may also be removed from the bath by other means than a conveyer, such as for instance by a scoop or by tilting the separating tank after the water has been discharged from the separating tank. The word "comprising" does not exclude that other items than the mentioned item or items are provided or that a larger number of the mentioned item is provided.

What is claimed is:

1. A water bath separator, comprising:

a tank for receiving a volume of water for forming a water bath having a top water surface; and a light material conveyor path extending from the tank such that an upstream end of the light material conveyor path is closely below the top water surface for engaging floating material when the tank is in filled operating condition;

wherein the light material conveyor path comprises a sorting conveyor comprising a row of rotatable, driven shafts mutually spaced in a conveying direction and each extending transversally to said conveying direction, said shafts each carrying a row of radially extending impellers for intermittently urging material on the sorting conveyor upward and in conveying direction, the impellers of each of said rows being mutually spaced in longitudinal direction of the respective shaft, said sorting conveyor having an upstream portion located in the tank such that an upstream end of the sorting conveyor is immersed in the water bath when the tank is in filled operating "condition" wherein at least some of the impellers carried by a most upstream one of said shafts are positioned to be fully immersed in the water bath when the tank is in filled operation condition.

2. A separator according to claim 1, wherein rotary trajectories of impellers carried by at least one of said shafts project between rotary trajectories of the impellers carried by a neighboring one of said shafts.

3. A separator according to claim 1, wherein said impellers each have a contour comprising at least one member projecting radially outward from adjacent portions of said contour.

4. A separator according to claim 2, wherein said impellers each have a contour comprising at least one member projecting radially outward from adjacent portions of said contour.

5. A separator according to claim 1, wherein said sorting conveyor extends over a sifting area for receiving undersize material and water fallen through the sorting conveyor.

6. A separator according to claim 2, wherein said sorting conveyor extends over a sifting area for receiving undersize material and water fallen through the sorting conveyor.

7. A separator according to claim 3, wherein said sorting conveyor extends over a sifting area for receiving undersize material and water fallen through the sorting conveyor.

8. A separator according to claim 4, wherein said sorting conveyor extends over a sifting area for receiving undersize material and water fallen through the sorting conveyor.

9. A separator according to claim 5, further comprising a sieve at least in or downstream of the sifting area for sieving water from the undersize material.

10. A separator according to claim 6, further comprising a sieve at least in or downstream of the sifting area for sieving water from the undersize material.

11. A separator according to claim 7, further comprising a sieve at least in or downstream of the sifting area for sieving water from the undersize material.

12. A separator according to claim 8, further comprising a sieve at least in or downstream of the sifting area for sieving water from the undersize material.

* * * * *